US006929458B2

(12) United States Patent
Hirabayashi et al.

(10) Patent No.: US 6,929,458 B2
(45) Date of Patent: Aug. 16, 2005

(54) OIL PUMP ROTOR

(75) Inventors: Katsumi Hirabayashi, Kariya (JP); Ichiro Kimura, Kariya (JP); Hirotaka Kurita, Kariya (JP); Katsuaki Hosono, Niigata (JP); Takashi Kobayashi, Tokyo (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 10/615,488

(22) Filed: Jul. 7, 2003

(65) Prior Publication Data

US 2004/0067150 A1 Apr. 8, 2004

(30) Foreign Application Priority Data

Jul. 10, 2002 (JP) ..... 2002-201264

(51) Int. Cl.[7] ..... F03C 2/00; F04C 2/00

(52) U.S. Cl. ..... 418/150; 418/166

(58) Field of Search ..... 418/150, 171, 418/166, 61.3

(56) References Cited

U.S. PATENT DOCUMENTS 4,108,017 A * 8/1978 Rouverol ..... 74/462
5,813,844 A * 9/1998 Hosono et al. ..... 418/150
5,876,193 A * 3/1999 Hosono et al. ..... 418/150
6,077,059 A * 6/2000 Hosono ..... 418/150

FOREIGN PATENT DOCUMENTS

JP 61004882 A * 1/1986 ..... F04C/2/10

* cited by examiner

*Primary Examiner*—Theresa Trieu
(74) *Attorney, Agent, or Firm*—Darby & Darby

(57) ABSTRACT

An internal gear oil pump rotor assembly which enables the construction of an oil pump that is compact and has high performance. In the oil pump rotor assembly having an inner rotor and an outer rotor, the number of teeth "Zi" of the inner rotor with trochoid tooth profiles is set to be equal to or fewer than "6", and a ratio Si/So is set so as to satisfy the following inequalities: $0.8 \leqq Si/So \leqq 1.3$, where Si is a cross-sectional area of one external tooth which is formed outside a root circle that is formed along the bottoms of the external teeth of the inner rotor, and So is a cross-sectional area of one internal tooth which is formed inside a root circle that is formed along the bottoms of the internal teeth of the outer rotor.

1 Claim, 3 Drawing Sheets

PRIOR ART

OIL PUMP ROTOR

BACKGROUND OF THE INVENTION

1. Field of the Invention

This invention relates to an oil pump rotor assembly used in a trochoid internal gear oil pump which draws and discharges fluid by volume change of cells formed between an inner rotor and an outer rotor when the inner rotor and the outer rotor rotate while engaging each other.

2. Background Art

A conventional oil pump includes an inner rotor having "n" external teeth (hereinafter "n" indicates a natural number), an outer rotor having "n+1" internal teeth which are engageable with the external teeth, and a casing in which a suction port for drawing fluid and a discharge port for discharging fluid are formed, and fluid is drawn and is discharged by rotation of the inner rotor which makes the outer rotor rotate due to engagement of the external teeth and internal teeth, and which produces changes in the volumes of cells formed between the inner rotor and the outer rotor.

Each of the cells is delimited at a front portion and at a rear portion as viewed in the direction of rotation by contact regions between the external teeth of the inner rotor and the internal teeth of the outer rotor, and is also delimited at either side portions by the casing, so that an independent fluid conveying chamber is formed. Each of the cells draws fluid as the volume thereof increases when the cell moves over the suction port after the volume thereof is minimized in the engagement process between the external teeth and the internal teeth, and the cell discharges fluid as the volume thereof decreases when the cell moves over the discharge port after the volume thereof is maximized.

The discharging capacity of such an oil pump could be increased, for example, by increasing the size of the rotors, by increasing an eccentric distance between the rotors so as to increase the volume of each of the cells, or by increasing the revolution rate of the rotors.

However, increase in diameters or thicknesses of the rotors and increase in the revolution rate of the rotors for increasing the discharging capacity are not preferable because increase in diameters or thicknesses of the rotors deviates from the trend in oil pump rotors in which small size is preferred, and increase in the revolution rate of the rotors may cause cavitation which may lead to decrease in pump efficiency, excessive wear, and increase in noise.

On the other hand, when the numbers of teeth of the rotors are reduced, the eccentric distance between the rotors is increased so that the discharging capacity is increased; however, hydraulic pulsation is increased because changes in drawing and discharging flow velocity of oil at the ports are increased and is due to the small number of teeth. As a result, not only does cavitation occur, but also pump efficiency is decreased because oil is drawn from a discharging cell due to excessive negative suction pressure, or because air is drawn through clearance in the casing.

As explained above, the above-described measures are not appropriate to increase the discharging capacity of an oil pump, i.e., such measures cannot fulfill recent requirements of compactness and high performance.

SUMMARY OF THE INVENTION

In view of the above circumstances, an object of the present invention is to provide an oil pump rotor assembly for use in an oil pump that is compact and has high performance.

In order to solve the above problems, the inventors of the present invention conducted research and concluded that an oil pump, which exhibits high discharging performance and low hydraulic pulsation even in an oil pump rotor assembly with a small number of teeth, can be obtained by appropriately adjusting a cross-sectional area ratio between the internal teeth of the outer rotor and the external teeth of the inner rotor so that changes in drawing and discharging flow velocities of oil are reduced, and the maximum value of the flow velocity is reduced without decreasing flow rate in one cycle of drawing and discharging.

The present invention was conceived based on the above research results. An internal gear oil pump rotor assembly according to the present invention includes: an inner rotor having "Zi" external teeth with trochoid tooth profiles; and an outer rotor having "Zo" internal teeth which are engageable with the external teeth, wherein the oil pump rotor assembly is used in an oil pump which further includes a casing having a suction port for drawing fluid and a discharge port for discharging fluid are formed, and which conveys fluid by drawing and discharging fluid by volume change of cells formed between the inner rotor and the outer rotor produced by relative rotation between the inner rotor and the outer rotor engaging each other, and wherein the number of teeth "Zi" of the inner rotor is set to be equal to or fewer than "6", and a ratio Si/So is set so as to satisfy the following inequalities: $0.8 \leqq Si/So \leqq 1.3$, where Si is a cross-sectional area of one external tooth which is formed outside a root circle "di" that is formed along the bottoms of the external teeth of the inner rotor, and So is a cross-sectional area of one internal tooth which is formed inside a root circle Do that is formed along the bottoms of the internal teeth of the outer rotor.

According to the present invention, the ratio Si/So is set so as to satisfy the following inequalities: $0.8 \leqq Si/So \leqq 1.3$, which means that the ratio Si/So is set to be much greater than that in a conventional oil pump, which is approximately 0.5. As a result, the volume change, due to rotation of the rotors, in each of the cells formed between the rotors is reduced, and changes in drawing and discharging flow velocities at the ports can be reduced so that the maximum value of the flow velocity is lowered.

In other words, even in an oil pump using an inner rotor having a small number of teeth, such as six or fewer, which could not be used in a conventional oil pump due to problems of excessive hydraulic pulsation and cavitation, hydraulic pulsation can be restrained while at the same time discharging capacity is increased, and thus a compact oil pump having high discharging efficiency and high performance can be obtained.

DETAILED DESCRIPTION OF THE PREFERRED EMBODIMENTS

Embodiments of an oil pump rotor assembly according to the present invention will be explained below.

Figure 1:
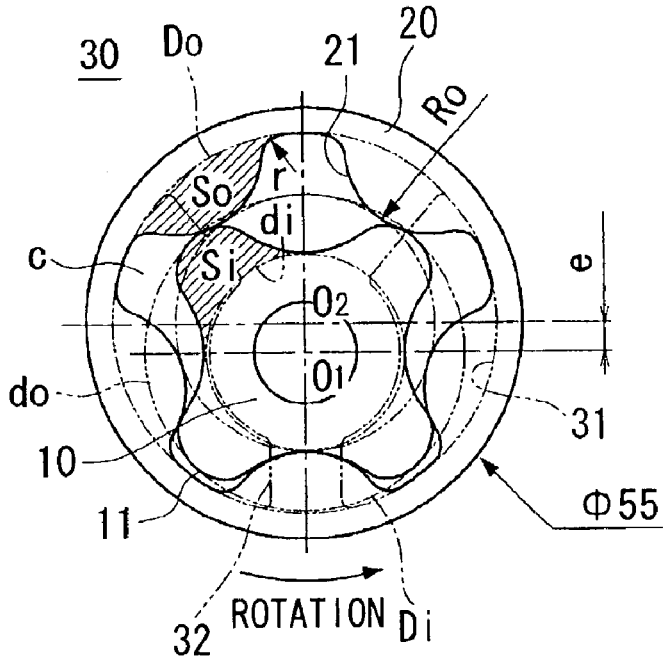
FIG. 1 is a plan view showing an oil pump rotor assembly as Example 1 of the present invention in which the inner and outer rotors thereof are formed so that a ratio Si/So equals 0.8, where Si is a cross-sectional area of one external tooth of the inner rotor, and So is a cross-sectional area of one internal tooth of the internal teeth of the outer rotor.

The oil pump rotor assembly shown in FIG. 1 includes an inner rotor 10 provided with "Zi" external teeth 11 with trochoid tooth profiles, an outer rotor 20 provided with "Zo" internal teeth 21 which are engageable with the external teeth 11 of the inner rotor 10. The oil pump rotor assembly is accommodated in a casing 30.

The inner rotor 10 is mounted on a rotational axis (not shown) so as to be rotatable about an axis O1. The outer rotor 20 is mounted so as to be rotatable, in the casing 30, about an axis O2 which is disposed so as to have an offset (the eccentric distance is "e") from the axis O1 of the inner rotor 10.

Each of the external teeth 11 of the inner rotor 10 and each of the internal teeth 21 of the outer rotor 20 are formed so that a ratio Si/So satisfies the following inequalities: $0.8 \leqq Si/So \leqq 1.3$, where Si is a cross-sectional area of one of the external teeth 11 which are formed outside a root circle "di" that is formed along the bottoms of the external teeth 11 of the inner rotor 10, and So is a cross-sectional area of one of the internal teeth 21 which are formed inside a root circle Do that is formed along the bottoms of the internal teeth 21 of the outer rotor 20.

Between the tooth surfaces of the inner rotor 10 and outer rotor 20, there are formed a plurality of cells C in the direction of rotation of the inner rotor 10 and outer rotor 20. Each of the cells C is delimited at a front portion and at a rear portion as viewed in the direction of rotation of the inner rotor 10 and outer rotor 20 by contact regions between the external teeth 11 of the inner rotor 10 and the internal teeth 21 of the outer rotor 20, and is also delimited at either side portions by the casing 30, so that an independent fluid conveying chamber is formed. Each of the cells C moves while the inner rotor 10 and outer rotor 20 rotate, and the volume of each of the cells C cyclically increases and decreases so as to complete one cycle in a rotation.

In the casing 30, a suction port 31 having a curved shape is formed in a region along which each of the cells C, which are formed between the rotors 10 and 20, moves while gradually increasing the volume thereof, and a discharge port 32 having a curved shape is formed in a region along which each of the cells C moves while gradually decreasing the volume thereof.

Each of the cells C draws fluid as the volume thereof increases when the cell C moves over the suction port 31 after the volume of the cell C is minimized in the engagement process between the external teeth 11 and the internal teeth 21, and the cell C discharges fluid as the volume thereof decreases when the cell C moves over the discharge port 32 after the volume of the cell C is maximized.

Next, Examples 1 to 3 of the oil pump rotor assemblies according to the present invention, in which the inner and outer rotors are formed so that the ratio Si/So satisfies the following inequalities: $0.8 \leqq Si/So \leqq 1.3$, where Si is a cross-sectional area of one of the external teeth 11 which are formed outside a root circle "di" that is formed along the bottoms of the external teeth 11 of the inner rotor 10, and So is a cross-sectional area of one of the internal teeth 21 which are formed inside a root circle Do that is formed along the bottoms of the internal teeth 21 of the outer rotor 20, and a Comparative Example of a conventional oil pump rotor assembly, in which the inner and outer rotors are formed so that the above inequalities are not satisfied, will be more specifically explained below.

Note that the oil pump rotor assemblies of Examples 1 to 3 and of Comparative Example are respectively configured so as to have the same theoretical discharging volume per revolution when being driven under conditions in which the revolution rate is set to be 1000 rpm, and discharging pressure is set to be 200 kPa.

EXAMPLE 1

The specifications of the oil pump rotor assembly of Example 1 shown in FIG. 1 are set as follows:

the diameter of the addendum circle Di of the inner rotor is 40.32 mm;
the diameter of the root circle "di" of the inner rotor is 25.36 mm;
the diameter of the root circle Do of the outer rotor is 48.20 mm;
the diameter of the addendum circle "do" of the outer rotor is 32.92 mm;
the eccentric distance "e" is 3.74 mm;
the radius of the inner rotor generating circle Ri is 10.80 mm;
the radius of the arc Ro of the tooth tip of the outer rotor is 10.80 mm;
the radius of the rounded corner "r" of the outer rotor is 3.00 mm;
the number of teeth "Zi" of the inner rotor is "4";
the number of teeth "Zo" of the outer rotor is "5";
the thickness of each of the teeth is 12.6 mm;
the theoretical discharging volume Vth is 9.32 $cm^3$/rev.; and
the area ratio Si/So per tooth is 0.8.

EXAMPLE 2

Figure 2:
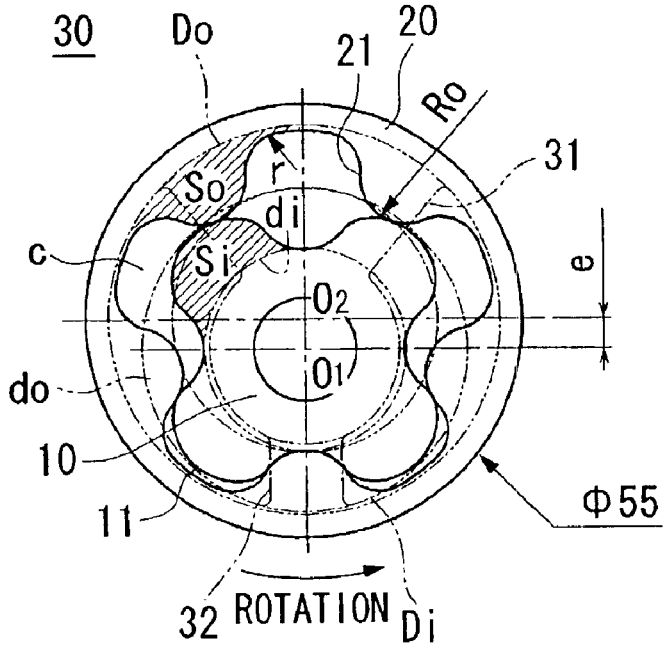
FIG. 2 is a plan view showing an oil pump rotor assembly as Example 2 of the present invention in which the inner and outer rotors thereof are formed so that the ratio Si/So equals 1.2.

The specifications of the oil pump rotor assembly of Example 2 shown in FIG. 2 are set as follows:

the diameter of the addendum circle Di of the inner rotor is 40.32 mm;
the diameter of the root circle "di" of the inner rotor is 25.36 mm;
the diameter of the root circle Do of the outer rotor is 48.20 mm;
the diameter of the addendum circle "do" of the outer rotor is 32.92 mm;
the eccentric distance "e" is 3.74 mm;
the radius of the inner rotor generating circle Ri is 5.90 mm;
the radius of the arc Ro of the tooth tip of the outer rotor is 5.90 mm;
the radius of the rounded corner "r" of the outer rotor is 5.00 mm;
the number of teeth "Zi" of the inner rotor is "4";
the number of teeth "Zo" of the outer rotor is "5";
the thickness of each of the teeth is 12.6 mm;
the theoretical discharging volume Vth is 9.32 $cm^3$/rev.; and
the area ratio Si/So per tooth is 1.2.

The oil pump rotor assembly of Example 2 differs from the oil pump rotor assembly of Example 1 in terms of the area ratio Si/So per tooth. In order to configure the oil pump rotor assembly of Example 2 so as to have the above area ratio Si/So, the radius of the inner rotor generating circle Ri, the radius of the arc Ro of the tooth tip of the outer rotor, and the radius of the rounded corner "r" of the outer rotor are set differently from the oil pump rotor assembly of Example 1, and the other dimensions are set to be the same as in Example 1.

EXAMPLE 3

Figure 3:
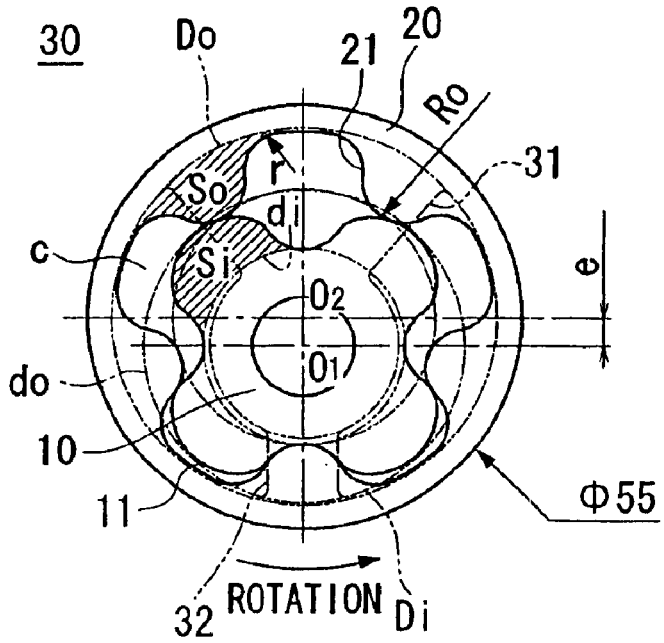
FIG. 3 is a plan view showing an oil pump rotor assembly as Example 3 of the present invention in which the inner and outer rotors thereof are formed so that the ratio Si/So equals 1.3.

The specifications of the oil pump rotor assembly of Example 3 shown in FIG. 3 are set as follows:

the diameter of the addendum circle Di of the inner rotor is 40.32 mm;

the diameter of the root circle "di" of the inner rotor is 25.36 mm;

the diameter of the root circle Do of the outer rotor is 48.20 mm;

the diameter of the addendum circle "do" of the outer rotor is 32.92 mm;

the eccentric distance "e" is 3.74 mm;

the radius of the inner rotor generating circle Ri is 5.30 mm;

the radius of the arc Ro of the tooth tip of the outer rotor is 5.30 mm;

the radius of the rounded corner "r" of the outer rotor is 5.00 mm;

the number of teeth "Zi" of the inner rotor is "4";

the number of teeth "Zo" of the outer rotor is "5";

the thickness of each of the teeth is 12.6 mm;

the theoretical discharging volume Vth is 9.32 $cm^3$/rev.; and the area ratio Si/So per tooth is 1.3.

The oil pump rotor assembly of Example 3 differs from the oil pump rotor assemblies of Examples 1 and 2 in terms of the area ratio Si/So per tooth. In order to configure the oil pump rotor assembly of Example 3 so as to have the above area ratio Si/So, when compared with Example 1, the radius of the inner rotor generating circle Ri, the radius of the arc Ro of the tooth tip of the outer rotor, and the radius of the rounded corner "r" of the outer rotor are differently set, and the other dimensions are set to be the same, and when compared with Example 2, the radius of the inner rotor generating circle Ri and the radius of the arc Ro of the tooth tip of the outer rotor are differently set, and the other dimensions are set to be the same.

COMPARATIVE EXAMPLE

Figure 4:
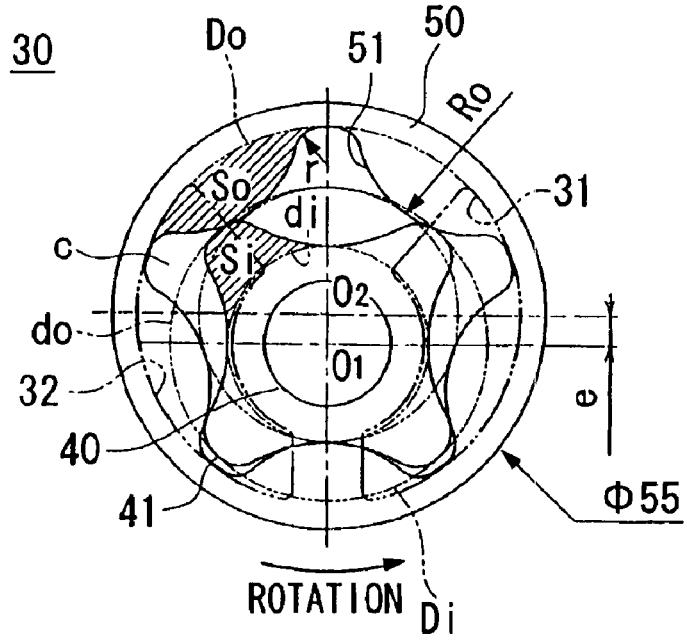
FIG. 4 is a plan view showing a conventional oil pump rotor assembly as Comparative Example in which the inner and outer rotors thereof are formed so that the ratio Si/So equals 0.618.

FIG. 4 shows an example of a conventional oil pump rotor assembly as a Comparative Example in which the inner and outer rotors are formed so that the inequalities "$0.8 \leqq Si/So \leqq 1.3$" are not satisfied.

The specifications of the oil pump rotor assembly of Comparative Example shown in FIG. 4 are set as follows:

the diameter of the addendum circle Di of the inner rotor is 40.32 mm;

the diameter of the root circle "di" of the inner rotor is 25.36 mm;

the diameter of the root circle Do of the outer rotor is 48.20 mm;

the diameter of the addendum circle "do" of the outer rotor is 32.92 mm;

the eccentric distance "e" is 3.74 mm;

the radius of the inner rotor generating circle Ri is 15.00 mm;

the radius of the arc Ro of the tooth tip of the outer rotor is 15.03 mm;

the radius of the rounded corner "r" of the outer rotor is 3.00 mm;

the number of teeth "Zi" of the inner rotor is "4";

the number of teeth "Zo" of the outer rotor is "5";

the thickness of each of the teeth is 12.6 mm;

the theoretical discharging volume Vth is 9.32 $cm^3$/rev.; and the area ratio Si/So per tooth is 0.618.

The oil pump rotor assembly of Comparative Example differs from the oil pump rotor assemblies of Examples 1 to 3 in terms of the area ratio Si/So per tooth. In the oil pump rotor assembly of Comparative Example, when compared with Example 1, the radius of the inner rotor generating circle Ri, and the radius of the arc Ro of the tooth tip of the outer rotor are differently set, and the other dimensions are set to be the same, and when compared with Examples 2 and 3, the radius of the inner rotor generating circle Ri, the radius of the arc Ro of the tooth tip of the outer rotor, and the radius of the rounded corner "r" of the outer rotor are differently set, and the other dimensions are set to be the same.

Figure 5:
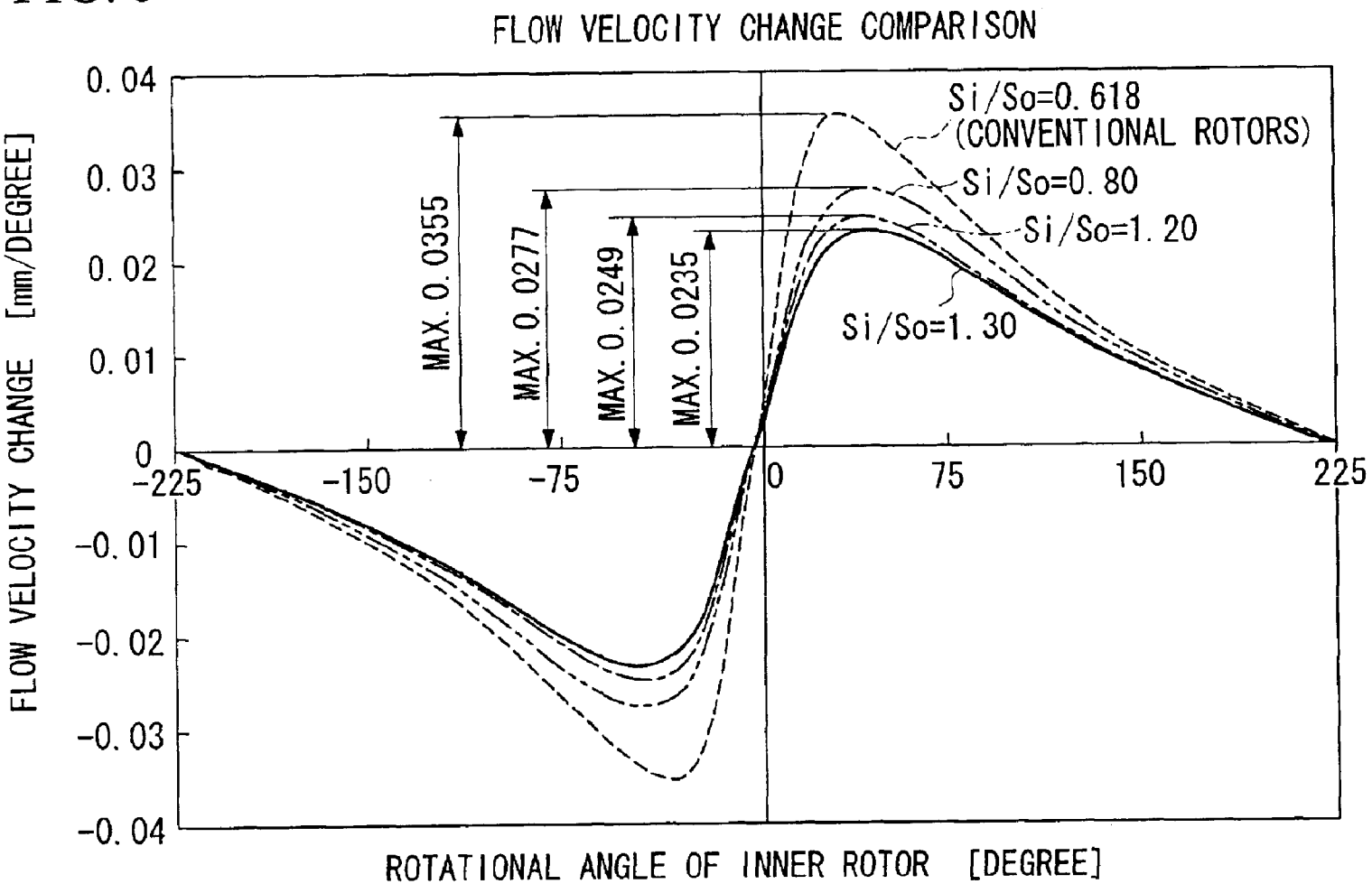
FIG. 5 is a graph showing comparison of flow velocity changes of the oil pumps respectively having the oil pump rotor assemblies according to Examples 1 to 3 shown in FIGS. 1 to 3, respectively, and the oil pump rotor assembly of the Comparative Example shown in FIG. 4.

FIG. 5 is a graph showing comparison of flow velocity change in each of the oil pumps according to the above Examples 1 to 3 and the Comparative Example. In FIG. 5, the horizontal axis represents rotational angle of the inner rotor, and the vertical axis represents flow velocity change which is obtained by dividing the flow volume rate due to volume change of the cell by the cross-sectional area. The signs of the flow velocity change are differently applied to a discharging state and a drawing state, respectively.

According to FIG. 5, in the oil pumps respectively using the oil pump rotor assemblies of the present invention, the maximum values of the flow velocity change are less than that in the conventional oil pump, and the curves representing flow velocity changes are flatter than that in the conventional oil pump. It is clear that the flow velocity change greatly varies when the area ratio Si/So is set to be less than 0.8.

The flow velocity change varies in each case as explained above, and consequently, discharging efficiencies of the oil pumps according to respective Examples are as follows:

in the case of Example 1 (Si/So=0.80), discharging efficiency is 85%;

in the case of Example 2 (Si/So=1.20), discharging efficiency is 87%;

in the case of Example 3 (Si/So=1.30), discharging efficiency is 90%; and in the case of Comparative Example (Si/So=0.618), discharging efficiency is 80%, when the revolution rate is 1000 rpm, and the discharging pressure is 200 kPa. As described above, the oil pumps respectively having the oil pump rotor assemblies therein exhibit higher discharging efficiencies than in the case of the conventional oil pump.

Moreover, when the shapes of the oil pump rotor assemblies according to the above Examples are compared, the inner teeth 21 of the outer rotor 20 are made smaller as the area ratio Si/So is set to be greater. When the inner teeth 21 are made smaller, contact pressure between the inner rotor 10 and the outer rotor 20 becomes greater, which may degrade wear resistance and impact resistance of the rotors, and thus such rotors are not preferable for practical use.

Accordingly, it is preferable to set the area ratio Si/So to be equal to or greater than 0.8, with which variation in flow velocity change is restrained, and to be equal to or less than 1.3, with which the strength of the rotors is ensured.

The preferable range of the area ratio Si/So slightly changes depending on the number of teeth of the rotors.

For example, when the number of teeth "Zi" of the inner rotor is "6", and the number of teeth "Zo" of the outer rotor is "7", the preferable range is as follows: $0.8 \leqq Si/So \leqq 0.85$, when the number of teeth "Zi" of the inner rotor is "5", and the number of teeth "Zo" of the outer rotor is "6", the preferable range is as follows: $0.8 \leqq Si/So \leqq 0.9$; and when the number of teeth "Zi" of the inner rotor is "4", and the number of teeth "Zo" of the outer rotor is "5", the preferable range is as follows: $0.8 \leqq Si/So \leqq 1.0$.

Advantageous Effects Obtainable by the Invention

As explained above, in a trochoid oil pump using the oil pump rotor assembly according to the present invention, by setting the ratio Si/So so as to satisfy the following inequalities: $0.8 \leqq Si/So \leqq 1.3$, i.e., by setting the ratio Si/So to be much greater than that in a conventional oil pump which is approximately 0.5, the volume change, due to rotation of the rotors, in each of the cells formed between the rotors is reduced, and variation in flow velocity changes during drawing and discharging at the ports can be reduced so that the maximum value of the flow velocity change is lowered.

Accordingly, even in an oil pump using an inner rotor having a small number of teeth, such as six or fewer, which could not be used in a conventional oil pump due to problems of excessive hydraulic pulsation and cavitation, hydraulic pulsation can be restrained while at the same time discharging capacity is increased, and thus a compact oil pump having high discharging efficiency and high performance can be obtained.

In addition, because pump efficiency is high, a sufficient performance can be ensured even when side clearance is set to be greater than that in a conventional oil pump. In other words, by using the oil pump rotor assembly according to the present invention, a sufficient discharging performance, which could be only obtained with accurately machined rotors in the case of a conventional oil pump, can be obtained even when dimensional accuracy of the rotors and the casing is degraded more than that in a conventional oil pump, and thus manufacturing cost of the oil pump rotor assembly can be reduced.

What is claimed is:

1. An internal gear oil pump rotor assembly, comprising:

an inner rotor having "Zi" external teeth with trochoid tooth profiles; and an outer rotor having "Zo" internal teeth which are engageable with the external teeth, wherein the oil pump rotor assembly is used in an oil pump which further includes a casing having a suction port for drawing fluid and a discharge port for discharging fluid are formed, and which conveys fluid by drawing and discharging fluid by volume change of cells formed between the inner rotor and the outer rotor produced by relative rotation between the inner rotor and the outer rotor engaging each other, and wherein the number of teeth "Zi" of the inner rotor is set to be equal to or fewer than "6", and a ratio Si/So is set so as to satisfy the following inequalities: $0.8 \leqq Si/So \leqq 1.3$, where Si is a cross-sectional area of one external tooth which is formed outside a root circle that is formed along the bottoms of the external teeth of the inner rotor, and So is a cross-sectional area of one internal tooth which is formed inside a root circle that is formed along the bottoms of the internal teeth of the outer rotor.

* * * * *